US008205415B2

(12) United States Patent
Sagy et al.

(10) Patent No.: US 8,205,415 B2
(45) Date of Patent: Jun. 26, 2012

(54) METHOD OF PACKAGING AND SHIPPING ROAST AND GROUND COFFEE

(75) Inventors: Arthur A. Sagy, Guttenberg, NJ (US); Piaras Valdis de Cleir, Tarrytown, NY (US)

(73) Assignee: Kraft Foods Global Brands LLC, Northfield, IL (US)

( * ) Notice: Subject to any disclaimer, the term of this patent is extended or adjusted under 35 U.S.C. 154(b) by 343 days.

(21) Appl. No.: 12/688,032

(22) Filed: Jan. 15, 2010

(65) Prior Publication Data

US 2010/0183777 A1 Jul. 22, 2010

Related U.S. Application Data

(60) Provisional application No. 61/145,405, filed on Jan. 16, 2009.

(51) Int. Cl.
*B65B 7/28* (2006.01)
*B65B 31/00* (2006.01)

(52) U.S. Cl. ..... 53/433; 53/471; 53/492

(58) Field of Classification Search ..... 53/433, 53/443, 471, 485, 486, 492, 511, 281, 286
See application file for complete search history.

(56) References Cited

U.S. PATENT DOCUMENTS

| | | | | |
|---|---|---|---|---|
| 1,511,093 | A | 10/1924 | Pfefferle | |
| 1,569,648 | A | 1/1926 | Tormo | |
| 2,235,101 | A | 3/1941 | Enkur | |
| D146,127 | S | 12/1946 | Billups | |
| 2,778,525 | A | 1/1957 | Lermer | |
| 3,117,873 | A * | 1/1964 | Bartels et al. | 53/486 |
| D198,404 | S | 6/1964 | Busch | |
| 3,174,641 | A | 3/1965 | Kitterman | |
| 3,181,720 | A | 5/1965 | Cassie et al. | |
| 3,320,993 | A | 5/1967 | Motsenbocker | |
| D217,439 | S | 5/1970 | Platte | |
| 3,904,063 | A | 9/1975 | Hauser | |
| 3,907,146 | A | 9/1975 | Fields | |
| 4,040,537 | A * | 8/1977 | Edwards | 206/520 |

(Continued)

FOREIGN PATENT DOCUMENTS

| | | |
|---|---|---|
| EP | 0356829 | 3/1990 |

(Continued)

*Primary Examiner* — Stephen F Gerrity
(74) *Attorney, Agent, or Firm* — Fitch, Even, Tabin & Flannery, LLP

(57) ABSTRACT

There is provided a packaged roast and ground coffee product comprising a lightweight, thin-walled reclosable container made of laminated plastic material comprising a moisture barrier and an oxygen barrier, and a quantity of roast and ground coffee disposed within the container. The container comprises a finish that includes a top surface and one or more snap beads positioned below the top surface. A plurality of snap bead segments may be circumferentially spaced from one another. A sealing member may be sealed to the top surface. The sealing member may include a one-way valve permitting venting of $CO_2$ resulting from off-gassing of the roast and ground coffee while preventing ingress of air. A removable overcap comprising a top wall and a depending skirt may be affixed to the finish. The skirt may include an inner surface with at least one locking member dimensioned to engage the snap beads in an interference fit so that the locking member and the snap beads are interengageable between locked and unlocked positions. The packaged roast and ground coffee is preferably capable of withstanding stacking loads typically encountered in distribution for retail sale, as well as loads associated with decreased interior pressure without permitting ingress of air.

7 Claims, 3 Drawing Sheets

U.S. PATENT DOCUMENTS 4,098,421 A 7/1978 Foster
4,646,933 A 3/1987 Jurczenia et al.
4,702,389 A 10/1987 Bozinovich et al.
4,760,936 A 8/1988 Mueller
4,890,752 A 1/1990 Ota et al.
D306,969 S 4/1990 Alberghini et al.
5,165,557 A 11/1992 Ota et al.
5,199,587 A 4/1993 Ota et al.
5,215,203 A 6/1993 Malcolm
5,226,550 A 7/1993 Mikolaitis et al.
5,344,662 A 9/1994 Payne et al.
5,368,178 A 11/1994 Towns et al.
5,392,937 A 2/1995 Prevot et al.
D370,850 S 6/1996 Beaver
D376,978 S 12/1996 Silvers et al.
5,598,941 A 2/1997 Semersky et al.
D379,763 S 6/1997 Ewing, Jr.
D382,807 S 8/1997 Silvers et al.
D383,067 S 9/1997 Gower et al.
D389,067 S 1/1998 Lown
D390,114 S 2/1998 Young
5,730,337 A 3/1998 Carlile, Jr. et al.
5,769,268 A 6/1998 Kuzma et al.
D420,587 S 2/2000 Cheng et al.
D421,220 S 2/2000 Larson et al.
6,029,837 A 2/2000 Slat et al.
6,164,474 A 12/2000 Cheng et al.
D448,674 S 10/2001 Mooney
6,349,839 B1 2/2002 Mooney
D458,849 S 6/2002 Burleson et al.
6,398,052 B1 6/2002 Cheng et al.
D462,012 S 8/2002 Manderfield, Jr.
6,477,823 B1 11/2002 Kitterman et al.
D473,142 S 4/2003 Beaver
D480,974 S 10/2003 Blank
D483,269 S 12/2003 Walsh et al.
6,677,013 B1 1/2004 Curie et al.
6,739,467 B2 5/2004 Saito et al.
D507,184 S 7/2005 Beaver et al.
D511,101 S 11/2005 Nottingham et al.
6,964,347 B2 11/2005 Miura
6,983,862 B2 1/2006 Nottingham et al.
7,074,443 B2 * 7/2006 Thomas et al. ..... 426/118
7,080,746 B2 7/2006 Saito et al.
7,097,060 B2 8/2006 Penny et al.
7,118,002 B2 10/2006 Saito et al.
7,169,418 B2 1/2007 Dalton et al.
7,169,419 B2 1/2007 Dalton et al.
D541,662 S 5/2007 Little et
D547,662 S 7/2007 Hankins et al.
D550,091 S 9/2007 Gruskin et al.
7,294,354 B2 11/2007 Gunter et al.
D564,887 S 3/2008 Gruskin et al.
D578,401 S 10/2008 Perry et al.
D582,289 S 12/2008 Kissinger et al.
7,481,325 B2 1/2009 Simpson et al.
D586,222 S 2/2009 Little et al.
D586,223 S 2/2009 Little et al.
D588,008 S 3/2009 Flanagan-Kent et al.
D591,600 S 5/2009 Dorn et al.
7,596,931 B2 10/2009 Gunter et al.
7,644,829 B2 1/2010 Little et al.
D612,257 S 3/2010 Wurster et al.
7,694,845 B2 4/2010 Tilton
7,770,752 B2 8/2010 Gruskin et al.
D623,954 S 9/2010 Hawry et al.
D625,194 S 10/2010 Thierjung et al.
7,913,874 B2 3/2011 Gruskin et al.
D639,173 S 6/2011 Dupuis et al.
D641,246 S 7/2011 Maas et al.
8,025,176 B2 9/2011 Little et al.
D649,467 S 11/2011 Sheridan et al.
8,047,398 B2 * 11/2011 Dimartino et al. ..... 220/783
D651,094 S 12/2011 Kissinger et al.
D655,176 S 3/2012 Kraft et al.
2003/0042222 A1 3/2003 Wurster et al.
2005/0040132 A1 2/2005 Saito et al.
2005/0252881 A1 11/2005 Zhang et al.
2006/0032857 A1 2/2006 Stensbol et al.
2006/0076356 A1 4/2006 Bocola
2007/0187412 A1 8/2007 Gruskin et al.
2007/0187420 A1 8/2007 Gruskin et al.
2007/0205196 A1 9/2007 Burney et al.
2008/0029475 A1 2/2008 Scarola
2008/0083695 A1 4/2008 Nievierowski
2008/0156765 A1 7/2008 Scarola et al.
2008/0156819 A1 7/2008 Scarola
2009/0038271 A1 * 2/2009 Nottingham et al. ..... 53/471
2009/0090721 A1 * 4/2009 Buisson et al. ..... 220/378
2009/0159557 A1 6/2009 De Vel et al.
2009/0266834 A1 10/2009 Mileti
2009/0289028 A1 11/2009 Sasaki et al.
2009/0289073 A1 11/2009 Moore et al.
2010/0180553 A1 * 7/2010 Tilton ..... 53/485

FOREIGN PATENT DOCUMENTS

EP 0409759 B1 1/1991
EP 0837006 4/1998
EP 1852357 11/2007
WO 02081313 10/2002
WO 02098752 12/2002
WO 2005056401 6/2005

* cited by examiner 106
108
302
102
110
100
112
D
109
105
120
118
107
120
116
104
d
111

METHOD OF PACKAGING AND SHIPPING ROAST AND GROUND COFFEE

FIELD

The invention relates to packaging and, in particular, to packaged roast and ground coffee.

BACKGROUND

Containers for retail packaging of roast and ground coffee are often equipped with a one-way valve to permit egress of carbon dioxide ($CO_2$) while substantially preventing ingress of air. Some such containers comprise a self-supporting, or rigid, plastic body, sealed with a peelable film cover, and a snap-on, snap-off plastic overcap. When such containers are transported from packaging plants to retail stores, they are sometimes transported over mountains at high enough altitudes (e.g., altitudes around 7000 feet) that significant internal pressure drops are experienced. In some cases, a drop of about 5 psi may occur during transport while the container is at high altitude, and upon returning to a lower altitude, the internal pressure will remain at about 5 psi below the external pressure, which may be, e.g., about 5 psi below atmospheric pressure at sea level. This can result in significant stress on the container seal(s).

For packages that comprise a rigid container with a removable peelable film cover, or film membrane, the strength of the seal that holds the cover to the container can be an issue. A wide sealing surface or rim can be advantageous in terms of providing more sealing area, and an outwardly extending structure at or near the top of the container may be used to facilitate snap-on engagement of an overcap with the container finish. However, an internal vacuum and the attendant downward force on the peelable film cover may result in radially inward stress on the mouth of the container causing a localized reduction of diameter and interfering with the function of retaining the overcap in snap-on, snap-off engagement, particularly in relatively thin-walled, lightweight containers, such that the vacuum forces substantially affect the lid fit.

When intermodal shipment of containers over mountains produces an internal vacuum within the containers, the vacuum can pull the sealing membrane down tightly around the opening of the container. Where the membrane is sealed to the container the downward force of the membrane can also pull the plastic walls of the container inward, such that the sealing surface is pulled downward and inward. Since the overcap engages the container high upon the neck finish, in the area of the sealing surface, this reduces the diameter of the outwardly extending structure (e.g., snap bead segments) that engages the overcap, thus resulting in a loose fit of the overcap.

Traditionally, the sealing surface of wide mouth extrusion blow molded bottles have a flange that projects inward and/or outward at the top of the finish to provide a sealing surface. The finish thus has a cross-section resembling an inverted "L" at the top. The wide-mouth sealing surface can have a flange width or sealing width that may range from 0.125 to 0.16 in. The flange overhanging the rim of the container is typically fairly flexible, and can flex or bend under pressure from a sealing head. Flexing can be desirable as it can help to allow the seal head to conform to the sealing surface and effect the seal. However, it can also be undesirable because it can result in the sealing surface bending too much, resulting in a poor contact area when the seal head comes down to effect the seal between the sealing membrane and the flange. This can result in a poorly sealed or unsealed membrane, which can result in the coffee being open to the atmosphere and cause premature staling of the coffee.

An inwardly extending flange at the sealing surface can also interfere with the pouring of coffee from the interior of the container.

Another problem with some prior containers is that they sometimes have nicks, uneven surfaces, dips, visible scars or other abrupt changes in the height or smoothness of the sealing surface. These inconsistencies in the surface can also interfere with creating a hermetic seal of the sealing membrane to the sealing surface. A secondary finishing treatment, e.g., burnishing or machining, may be used to smooth the sealing surface; however, this results in an additional cost to the process as well as reducing the line efficiency in production. Sealing materials, e.g., Surlyn® from DuPont, can also be used as a "caulk" to attempt to fill in the interruptions, gaps and/or uneven surfaces in the sealing surface; however, these attempts at filling in the interruptions, etc. often are not successful.

Alternatively, a flat sealing surface can be obtained by the injection blow molding process; however, the injection blow molding process is not well suited to making multilayer bottles, e.g., from multilayer materials such as high density polyethylene (HDPE)/ethylene vinyl alcohol (EVOH)/HDPE, and is not well suited to making bottles with handles.

Additionally, the wide sealing surface due to the inward and outward flanges can require a higher removal force to remove the sealing membrane. This can be especially undesirable for consumers who have difficulties grasping and pulling on the membrane tab to open. Bottles or containers having a straight wall finish would provide a smaller sealing surface which can result in application of a lower removal force to remove the sealing membrane.

SUMMARY

There is provided a packaged roast and ground coffee product comprising a lightweight, thin-walled reclosable container made of laminated plastic material comprising a moisture barrier and an oxygen barrier, and a quantity of roast and ground coffee disposed within the container. The container comprises a finish that includes a top surface and one or more snap beads spaced below the top surface. A plurality of snap bead segments may be circumferentially spaced from one another.

A sealing member may be sealed to the top surface. The sealing member may include a one-way valve permitting venting of $CO_2$ resulting from off-gassing of the roast and ground coffee while preventing ingress of air. A removable overcap comprising a top wall and a depending skirt may be affixed to the finish. The skirt may include an inner surface with at least one locking member dimensioned to engage the snap beads in an interference fit so that the locking member and the snap beads are interengageable between locked and unlocked positions. The packaged roast and ground coffee is preferably capable of withstanding stacking loads typically encountered in distribution for retail sale, as well as loads associated with decreased interior pressure without permitting ingress of air.

The finish may have a "straight wall" configuration, i.e., the finish may comprise a generally cylindrical wall without any flange. The straight wall finish can have a narrower seal width than containers with flanges at the top surface, such that the seal width at the top surface is 0.045 in. to 0.1 in., preferably about 0.075 in. This can result in a lower removal force for the membrane by reducing the seal area of the membrane.

The straight wall finish can also provide a top surface that can more consistently form a hermetic seal with the sealing member, by providing a more planar top surface.

The finish may be susceptible to radially inward creep in reaction to pressure within the container being maintained below external pressure. The magnitude of the radially inward creep is a function of pressure differential and location on the finish. The radially inward creep is greatest at the top surface, and decreases as a function of distance below the top surface. The snap beads are preferably spaced below the top surface by a predetermined distance sufficient to avoid unacceptable radially inward creep by an amount that would permit removal of, the overcap by application of opening force without desired audible and tactile indications of interengagement or disengagement. Placing the snap bead segments a sufficient distance below the top surface of the container reduces the displacement of the snap beads and improves the fit of the cap.

When the snap bead is placed at a greater distance from the top surface sealing edge, a portion of the sealing member which extends beyond the edge can be folded over by the cap placement, the folded over portion remaining above the snap bead segments and not interfering with the cap fit.

BRIEF DESCRIPTION OF DRAWINGS

Preferred embodiments will now be described, by way of example only, with reference to the accompanying drawings in which.

DETAILED DESCRIPTION OF PREFERRED EMBODIMENTS

Figure 1:
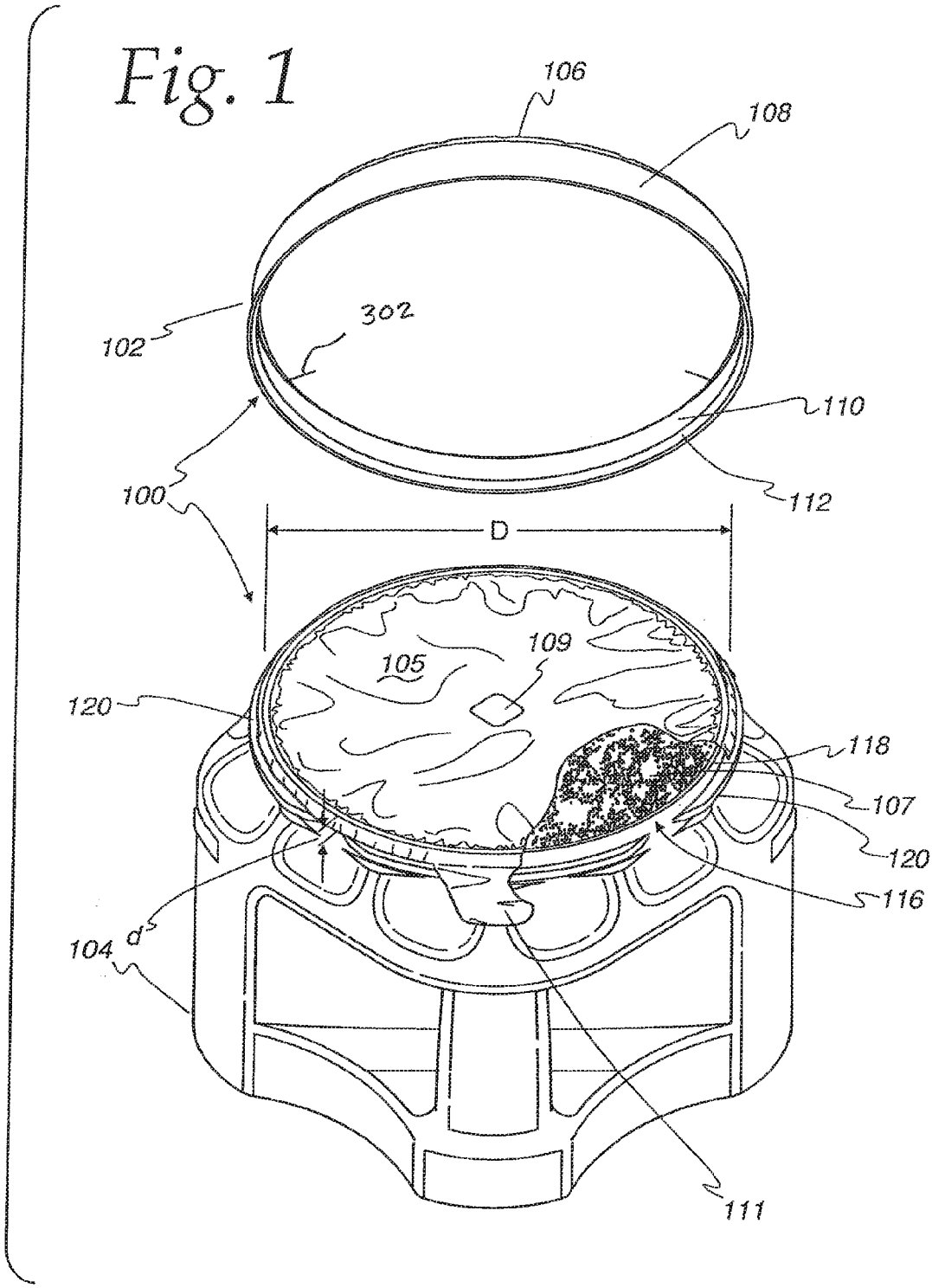
FIG. 1 is a perspective view of an unassembled, sealed container and an overcap.

FIGS. 1 to 4 illustrate a packaged roast and ground coffee product in accordance with a preferred embodiment. As shown in FIG. 1, the packaged roast and ground coffee 100 generally comprises a lightweight, thin-walled container 104, a removable overcap 102, a sealing member 105 or film membrane, and roast and ground coffee 107 disposed within the lightweight, thin-walled container 104.

The removable overcap 102 comprises a top wall 106 and a depending skirt 108. The depending skirt 108 has an inner surface 110 with at least one locking member 112.

The lightweight, thin-walled container 104 preferably comprises laminated plastic material comprising a moisture barrier and an oxygen barrier. The plastic material may comprise, e.g., polyolefins or polyalkenes such as polyethylene, polypropylene, polyvinyl alcohol (PVOH), ethylene vinyl alcohol (EVOH), cyclic olefin copolymer (COC), or polylactic acid (PLA). In one embodiment, the laminated plastic material comprises the following layers, with their approximate thicknesses as a percentage of total thickness indicated, listed in order from interior to exterior:

1. An inner layer of high density polyethylene (HDPE), to 15%, which may be, e.g., 10%, which functions as a moisture barrier.
2. A first adhesive or bonding layer, 0.5% to 5%, or e.g., 1.75%;
3. An oxygen barrier layer of a material such as ethylene vinyl alcohol (EVOH), 0.5% to 5%, or e.g., 1.5%
4. A second adhesive or bonding layer, 0.5% to 5%, or e.g., 1.75%;
5. A regrind layer, 40% to 80%, or e.g., 60%; and
6. An outer layer of HDPE with color, 15% to 40%, or, e.g., 25%.

Other materials having suitable mechanical, chemical and barrier properties may of course be used.

The container 104 defines a circular opening with a diameter D, as illustrated in FIG. 1. The diameter D may be between about 4 to about 6.5 inches and preferably between about 5 to about 6 inches. In some embodiments, the diameter D is at least 4 inches. In some embodiments, the diameter D can be between about 5.4 to about 5.6 inches. The container 104 is a wide mouth container, which can be defined as a container having a diameter D at least about 4 inches or greater. This allows a typical consumer to easily insert a scoop or similar utensil to access the roast and ground coffee. A large opening is especially useful when the level of roast and ground coffee in the container 104 is low, and the user may insert a hand partially or fully into the container 104 to access the roast and ground coffee. Smaller or larger diameters may be used in other embodiments.

The container 104 preferably comprises a straight wall finish 116 that includes a top surface, or sealing surface, 118 and one or more snap bead segments 120 positioned below the top surface 118. The straight wall finish 116 has a narrow seal width at its top surface 118 and does not have a flange at its top surface 118. A plurality of snap bead segments 120 may be circumferentially spaced from one another. The top surface 118 has a radial dimension that may be equal to the wall thickness of the container at its upper end. In some embodiments, the radial dimension is less than 0.10 in. and is substantially equal to the wall thickness. In some embodiments, the radial dimension of the top surface 118 is between 0.045 in. to about 0.1 in. In some embodiments, the radial dimension is between 0.060 in. to about 0.090 in. In these embodiments, the top surface 118 may be formed simply by cutting through the finish 116.

The straight wall finish 116 can have a flat sealing surface at the top surface 118, which does not contain uneven areas or other abrupt changes in the height of the top surface 118, such that the top surface 118 is generally smooth. A smooth top surface 118 facilitates consistently forming a hermetic seal with the sealing member 105. A planarity measurement can be used to quantify the degree of levelness of the top surface 118. A desirable levelness can be defined as a top surface 118 with no abrupt changes in the flatness of the sealing surface 118. In some embodiments the planarity measurement does not exceed 0.020 in. around any 0.5 in. circumferential length of the top surface 118.

In some embodiments, the planarity of the sealing surface 118 does not exceed about 0.015 in. around any 1.0 in. circumferential length of the top of the sealing surface 118.

In some embodiments, the planarity of the sealing surface 118 does not exceed about 0.012 in. around any 1.5 inches circumferential length of the top sealing surface 118.

The container 104 can have an average wall thickness that generally increases from bottom to top such that sufficient resistance to buckling is provided in the upper regions of the container 104, where less support and buckling resistance is provided by the coffee. The coffee provides additional structural support to the lower regions of the container 104 when stacking, where the wall thickness can be less than in the upper regions. The upper regions can be thicker to provide greater support in areas where the coffee is not present. In some embodiments, the container 104 can have an internal volume of at least about 119 ounces and an empty weight of no more than about 6.7 ounces (about 190 grams).

In some embodiments, the container 104 can have an internal volume of at least about 119 ounces and an empty weight of no more than about 6.2 ounces (about 175 grams).

In some embodiments, the container 104 can have an internal volume of at least about 97 ounces and an empty weight of no more than about 5.1 ounces (about 145 grams). Preferably, the container 104 can have an empty weight of between about 130 grams (about 4.6 ounces) to about 190 grams (about 6.7 ounces). If adequate functionality of the container 104 can be achieved, then the empty weight can be even lower.

The finish 116 is susceptible to radially inward creep in response to pressure within the lightweight, thin-walled container 104 being maintained below external pressure. The magnitude of the radially inward creep is a function of pressure differential, length of time exposed to pressure, and location on the finish 116. The radially inward creep is greatest at the top, and decreases as a function of distance below the top surface 118. The top surface 118 may have a chamfered outer edge.

Figure 3:
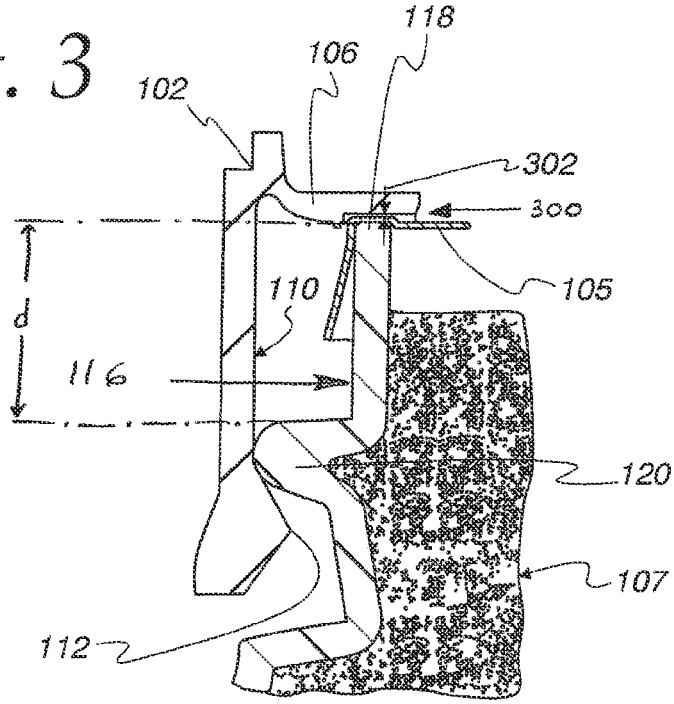
FIG. 3 is an enlarged cross-sectional view of a portion of a removable overcap interacting with a portion of a finish of a container.

The snap bead segments 120 are spaced below the top surface 118 by a predetermined distance d, as illustrated in FIGS. 1 and 3. The predetermined distance d is sufficient to avoid excessive radially inward displacement of the snap bead segments 120. In other words, the snap bead segments 120 are preferably positioned such that vacuum forces acting upon the sealing member 105 do not substantially affect the overcap fit on the container 104.

Radially inward displacement of the snap bead segments 120 may be considered excessive when the removable overcap 102 may be removed by application of opening force without sufficient audible and tactile indications of interengagement or disengagement of the locking member 112 and the plurality of snap bead segments 120.

The predetermined distance d is preferably such that the sealing member 105 does not interfere with the interengagement or disengagement of the locking member 112 of the removable cap 102 and the plurality of snap bead segments 120. In some embodiments, the predetermined distance d is at least 1/16 in., and preferably at least 3/16 in. and no more than 5/8 in. The preferred range may be between about 1/8 in. and about 3/8 in. In some embodiments, as the distance d becomes larger the opening force becomes greater due to the interference fit between the overcap 102 and the finish 116 becoming tighter.

The sealing member 105, or membrane, is sealed to the top surface 118 of the container 104. The sealing member 105 can extend radially outward beyond the top surface 118 of the container and downward along the finish 116 within the skirt 108 of the overcap 102, and may have a lower edge disposed above the plurality of snap bead segments 120. As noted above, the snap bead segments 120 are preferably positioned below the point at which the sealing member 105 rests on the finish 116 when folded over the sealing surface 118 by the placement of the overcap 102.

The sealing member 105 has a one-way valve 109 that permits egress of $CO_2$ produced from off-gassing of the roast and ground coffee, while also preventing ingress of air into the container 104. The venting of $CO_2$ prevents pressure damage to the sealing member 105, the container 104 and the seal therebetween due to pressure build-up, while also preventing ingress of air into the container 104, preserving the freshness and aroma of the roast and ground coffee.

The sealing member 105 may include aluminum foil, plastic, paper-based sealing lidstock, and other similar sealing structures. In some embodiments, the sealing member 105 preferably comprises a metallic barrier layer, such as aluminum laminated to one or more layers of polymeric materials to provide strength and toughness and to facilitate sealing. Polymeric materials that may be usable in this context include polyethylene terephthalate (PET), oriented polypropylene (OPP), polyamide, polybutylene-1, ethylene methacrylic acid, and combinations thereof. Other barrier materials such as EVOH polyamide, metallized PET, metalized polypropylene, metalized OPP, PVOH, and combinations thereof may also be used. The sealing member may also optionally include a pull tab 111 to facilitate opening.

The sealing member 105 may be sealed to the top surface 118 by induction sealing, conduction sealing, impulse sealing, spin welding, adhesives, or other means. As noted above, transportation at varying altitudes may result in an internal pressure lower than the external pressure, creating an internal vacuum. In some cases, the pressure within the container 104 is between 4 and 6 psi below external pressure, and more specifically may be about 5 psi below external pressure. In some embodiments, the internal pressure is about 4 psi below external pressure. The seal is preferably capable of maintaining seal integrity when the sealing member 105 is subjected to expected conditions, such as a force of up to 135 pounds resulting from a pressure differential of up to 5 psi. This enables the packaged roast and ground coffee to remain sealed during and after transportation through regions of varying elevations and altitudes, and thus varying pressures.

The container 104 and the seal also are capable of withstanding stacking loads typically encountered during transport, storage, etc. Such stacking loads may be, e.g., up to about 190 pounds.

The sealing member 105 is preferably easy for the consumer to remove and, to this end, in some embodiments requires an opening force of between about 2 lbs. and about 8 lbs., preferably not greater than about 15 lbs. Some packages require about 9 lbs. removal force to open sealing members 105. In other packages, the removal force may be about 5 lbs., which may be preferable and compliant with current AARP guidelines.

To avoid unacceptable variations in the forces associated with removal and replacement of the overcap 102, it may be desirable to provide flexibility in the interengagement of the overcap 102 and snap bead segments 120. To this end, the non-continuous nature of the plurality of snap bead segments 120 may allow the removable overcap 102 to perform more satisfactorily over a wider range of conditions, such as when dimensional variances within tolerances occur, as it snaps in and out of locked positions during use.

Figure 2:
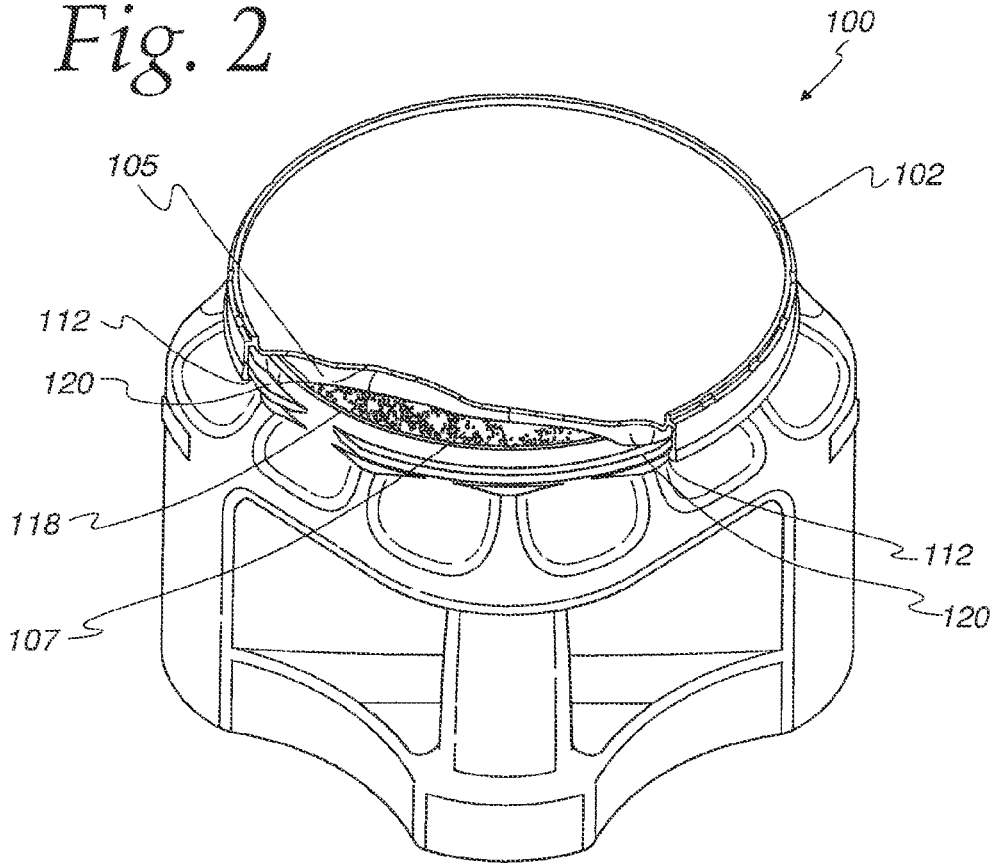
FIG. 2 is a perspective view of an assembled container.

As shown in FIG. 2, when the package is closed, the locking member 112 of the removable overcap 102 and the plurality of snap bead segments 120 on the finish 116 are in a locked position. The locking member 112 and the plurality of snap bead segments 120 interfere with one another when the overcap 102 is moved between locked and unlocked positions.

To remove the overcap 102, the user applies pressure in an upward direction on the skirt 108 of the overcap 102. There will be audible and tactile indications of unlocking as the locking member 112 engages and disengages one or more of the plurality of snap bead segments 120. Under certain circumstances, for example where manufacturing tolerances have permitted more than optimal interference, portions of the locking member 112 may deform inward into the gaps between the snap bead segments 120 to a sufficient degree to reduce resistance from unacceptable levels to acceptable levels as it is pushed upward.

It is desirable that the force required to initially remove the overcap 102 with the sealing member 105 in place, i.e., the initial cap removal force, be about 1.5 to about 10 lbs., and preferably about 2.5 to about 4.5 lbs. The preferred removal force may be chosen to be compliant with current AARP guidelines.

This initial force may be greater than the cap removal force required for reopening after the sealing member 105 has been removed. It is believed that this may be due to the thickness of the sealing member 105. In particular, the pull tab ill may extend beyond the top surface 118, down the finish 116 and over a region of the snap bead segments 120, and may provide interference between the finish 116 and the overcap 102, creating a tighter fit.

Another reason for the slightly greater removal force may be that sealing of the sealing member 105 to the top surface 118, applies a force to the top surface 118 of the container 104 such that the outer perimeter of the top surface 118 is constrained in a particular configuration, and that after removal of the sealing member, the finish may "relax" to a slightly different configuration, and/or become more flexible. For example, prior to sealing the sealing member 105, the top surface 118 of the container 104 may not be perfectly circular, e.g., it may have a slightly oval configuration. When the sealing member 105 is sealed to the top surface 118, the top surface 118 may be forced into a substantially circular configuration, and the seal may then hold the top surface 118 of the container 104 in a circular configuration. This can provide a tighter fit with the overcap 102, thus, requiring a slightly greater force to remove the overcap 102 initially, prior to removing the sealing member 105.

When the containers are mass produced, there will be variations in the required initial cap removal force from container to container. It is desirable to avoid excessive variation in required initial cap removal force, and it is desirable that the standard deviation σ of required initial cap removal force among the containers be no more than about 1.7, and preferably no more than about 0.8.

After initial removal of the cap 102, and after the sealing member 105 has been removed and the cap 102 has been replaced, the force required to again remove the cap 102, i.e., the cap 102 removal force required for reopening, may be less than the required initial cap removal force. It is desirable that the cap removal force required for reopening be between 1 and 9 lbs., preferably between about 2 and about 5 lbs. It is desirable that the standard deviation σ of the cap removal force required for reopening be no more than about 1.7, and preferably be no more than about 0.8.

Figure 4:
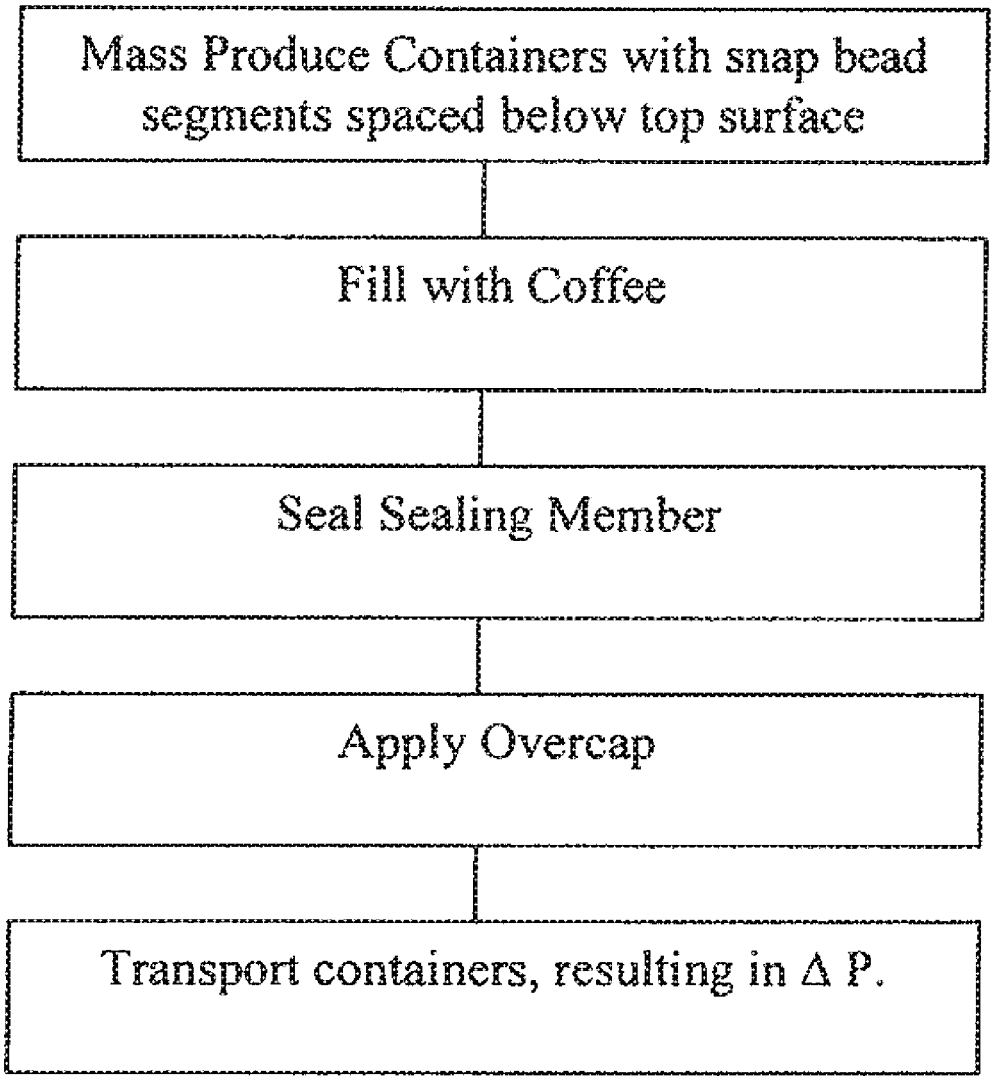
FIG. 4 is a flow diagram illustrating the process of manufacture and shipping.

As shown in FIG. 4, the containers 104 having a straight wall finish 116 and snap bead segments 120 spaced below the top surface 118 can be mass produced. The containers 104 having such a wide diameter can be made by using extrusion blow molding techniques.

After the containers 104 are made they are filled with coffee 107. The sealing member 105 is sealed to the top surface 118. The overcap 102 is then applied over the sealing member 105. Finally, the containers 104 are transported. Where intermodal shipping is utilized, some containers 104 may be exposed to a pressure differential from travelling over mountains with an altitude of, e.g., about 7000 feet.

As the containers 104 go higher in altitude, the ambient air pressure will decrease and interior pressure of the container 104 will also decrease. On the trip downward, the external air pressure starts to increase. Since the air pressure inside of the container 104 still matches the external air pressure at the highest altitude, the pressure inside of the container is negative, relative to the outside air pressure. Thus, there is a vacuum within the container, pulling the sealing member 105 tighter around the opening and pulling the finish 116 inward.

Example 1

In one example, 42 containers in accordance with one embodiment having a target weight of 143 g were filled, sealed, capped and shipped on the bottom of a two-pallet stack. After shipping that resulted in an internal pressure reduction of about 4 psi below ambient pressure the containers had an average initial cap removal force of 6.58 lbs., with a standard deviation σ of 0.83.

In comparison, 42 comparative containers were tested that did not have the snap bead segments spaced below the top surface, but rather the snap bead segments were positioned at or adjacent the top surface of the container. These 42 comparative containers also having a target weight of 143 g, were filled, sealed, capped and shipped on the bottom of a two-pallet stack. After shipping that resulted in an internal pressure reduction of about 4 psi below ambient pressure the containers had an average initial cap removal force of about 14.36 lbs., with a standard deviation σ of 2.10.

Thus, the containers made in accordance with the above embodiment resulted in a significantly lower initial cap removal force.

Example 2

In a second example, 42 containers in accordance with a second embodiment having a target weight of 145 g were filled, sealed, capped and shipped on the bottom of a two-pallet stack. After shipping that resulted in an internal pressure reduction of about 4 psi below ambient pressure the containers had an average initial cap removal force of 6.49 lbs., with a standard deviation σ of 0.74.

Thus, the initial cap removal force for the containers made in accordance with the above embodiment also had a significantly lower and more predictable removal force than the comparative containers of Example 1.

The cap removal forces may be measured by a device that applies localized upward force to the bottom of the skirt 108 of the overcap 102 in a manner analogous to the application of force by a typical consumer.

To re-lock the overcap 102, the user applies a light pressure downward. As the removable overcap 102 is pressed down, the locking member 112 of the removable overcap 102 engages one or more of the plurality of snap bead segments 120 in an interference fit, then passes over them, locking the container 104 shut, with audible and tactile indications of locking. Again, the non-continuous nature of the snap bead segments 120 may allow the locking mechanism to perform acceptably over a wider range of conditions as the removable overcap 102 snaps into a locked position.

FIG. 3 shows an enlarged cross-sectional view. As shown in FIG. 3, the top wall 106 of the removable overcap 102 comprises an inner surface 110 having a vent structure 300. The vent structure 300 overlies the top surface 118 of finish 116. The vent structure allows $CO_2$ produced by off-gassing of the roast and ground coffee 107 and released through the one-way valve 109 of the sealing member 105 to escape from the closed, sealed package. This helps control pressure under the overcap 102. The vent structure 300 in the illustrated embodiment comprises a horizontal groove in the underside of the overcap 102. The groove has a vertical dimension 302 that may be, e.g., about 0.004 inches to 0.012 inches. The length or radial dimension of the groove is greater than the radial dimension of the top surface 118. The width of the groove may be about 0.1 inches or greater. In one embodiment, the width of the groove is about 0.1 inches to about 0.3 inches.

While preferred embodiments have been described above and illustrated in the drawings, these are by way of example only and non-limiting. Any one or more of the features described herein may be provided in isolation or in various combinations in any of the embodiments. Any one or more of these features may be removed, substituted for and/or added to any of the feature combinations described. Thus, any of the features of any embodiment may be combined with any other feature from any other embodiment.

The invention claimed is:

1. A method of packaging and shipping roast and ground coffee comprising:

mass producing a plurality of lightweight, thin-walled containers made of laminated plastic material comprising a moisture barrier and an oxygen barrier;

for each container, providing a quantity of roast and ground coffee disposed within said container;

each said container comprising a finish that includes a top surface and a plurality of snap bead segments circumferentially spaced from one another;

for each container, sealing a sealing member to said top surface, said sealing member having a one-way valve permitting venting of $CO_2$ resulting from off-gassing of said roast and ground coffee while preventing ingress of air;

for each container, providing a removable overcap comprising a top wall and a depending skirt, said skirt having an inner surface with at least one locking member dimensioned to engage one or more of said snap bead segments in an interference fit so that said locking member and said snap bead segments are interengageable between locked and unlocked positions;

said container being capable of withstanding stacking loads as well as loads associated with decreased interior pressure while substantially preventing ingress of air;

said finish being susceptible to radially inward creep in response to pressure within said container being maintained below external pressure, the magnitude of said radially inward creep being a function of pressure differential, time, and location on said finish;

said radially inward creep being greatest at said top surface, and decreasing as a function of distance below said top surface;

transporting said containers over a route that varies in elevation such that an internal pressure of at least some of said containers is reduced by more than 4 psi below external pressure;

for each container, said snap bead segments being spaced below said top surface by a predetermined distance sufficient to avoid unacceptable radially inward creep of said snap bead segments when reduced pressure within said container results in inward deformation of said top surface; and said overcaps of said containers being removable upon application of a required initial cap removal force of about 1.5 lbs. to about 10 lbs. wherein a standard deviation $\sigma$ of the required initial cap removal force is no more than about 1.7.

2. The method of claim 1 wherein the required initial cap removal force is about 2.5 lbs. to about 4.5 lbs.

3. The method of claim 2 wherein a cap removal force required for reopening is between about 1 and about 9 lbs.

4. The method of claim 3 wherein the cap removal force required for reopening is between about 2 and about 5 lbs.

5. The method of claim 1 wherein the standard deviation $\sigma$ of the required initial cap removal force is not more than about 0.8.

6. The method of claim 1 wherein the finish has a diameter of at least 4 inches and the containers are made by extrusion blow-molding.

7. The method of claim 1 wherein the internal pressure of the containers at the time of opening varies from ambient pressure to about 4 psi below ambient pressure.

* * * * *